US011959381B2

(12) United States Patent
Branson et al.

(10) Patent No.: US 11,959,381 B2
(45) Date of Patent: Apr. 16, 2024

(54) MULTIPURPOSE DRILL SYSTEM

(71) Applicant: Intelligent Drilling Applications & Technology Pty Ltd, Bibra Lake (AU)

(72) Inventors: Jeff William Branson, Head (AU); Warren Barry Fair, Kalamunda (AU); Steven John Payne, Wooroloo (AU); James Daniel Chomley, Meadow Springs (AU); John Edward Kennedy, Jane Brook (AU); David Bruce Carnegie-Smith, Walliston (AU)

(73) Assignee: Intelligent Drilling Applications & Technology Pty Ltd., Bibra Lake (AU)

( * ) Notice: Subject to any disclaimer, the term of this patent is extended or adjusted under 35 U.S.C. 154(b) by 922 days.

(21) Appl. No.: 16/961,580

(22) PCT Filed: Jan. 10, 2019

(86) PCT No.: PCT/AU2019/050011
§ 371 (c)(1),
(2) Date: Jul. 10, 2020

(87) PCT Pub. No.: WO2019/136521
PCT Pub. Date: Jul. 18, 2019

(65) Prior Publication Data

US 2020/0370374 A1 Nov. 26, 2020

(30) Foreign Application Priority Data

Jan. 10, 2018 (AU) ..... 2018900079

(51) Int. Cl.
*E21B 6/08* (2006.01)
*E21B 7/02* (2006.01)

(52) U.S. Cl.
CPC ..... *E21B 6/08* (2013.01); *E21B 7/022* (2013.01)

(58) Field of Classification Search
CPC ..... E21B 6/08; E21B 7/022
See application file for complete search history.

(56) References Cited

U.S. PATENT DOCUMENTS 3,220,494 A * 11/1965 Cannon ..... E21B 7/28 173/4
2007/0246262 A1* 10/2007 Brookover ..... E21B 21/16 175/122
2017/0009542 A1* 1/2017 Homma ..... E21B 21/08

FOREIGN PATENT DOCUMENTS

WO WO-2009077656 A1 6/2009

OTHER PUBLICATIONS

International Search Report and Written Opinion of the International Searching Authority, issued in PCT/AU2019/050011, dated Mar. 18, 2019; ISA/AU.
International Preliminary Report on Patentability, issued in PCT/AU2019/050011, dated Jan. 13, 2020.

* cited by examiner

*Primary Examiner* — Nathaniel C Chukwurah
(74) *Attorney, Agent, or Firm* — Harness, Dickey & Pierce, PLC

(57) ABSTRACT

The present invention relates to a multipurpose drill system, the multipurpose drill system comprising: a drilling rig adapted to drive a drilling assembly; and two or more power sources, wherein at least one of the two or more power sources is a high pressure power source, wherein the drilling assembly is adapted to be in communication with either or both of the two or more power sources.

11 Claims, 4 Drawing Sheets

MULTIPURPOSE DRILL SYSTEM

CROSS-REFERENCE TO RELATED APPLICATIONS

This application is a 371 U.S. National Phase of International Application No. PCT/AU2019/050011, filed Jan. 10, 2019, which claims priority to Australian Patent Application No. 2018900079 filed Jan. 10, 2018. The entire disclosures of the above applications are incorporated herein by reference.

TECHNICAL FIELD

The present invention relates to a multipurpose drill system. More specifically, the multipurpose drill system of the present invention is intended to allow for multiple drilling arrangements on a single drilling rig platform. This provides an operator with the ability to use different drilling methods on a single rig. The present invention has been found to be particularly useful when drilling large diameter holes (>200 mm) in both hard and soft rock formations.

BACKGROUND ART

The following discussion of the background art is intended to facilitate an understanding of the present invention only. The discussion is not an acknowledgement or admission that any of the material referred to is or was part of the common general knowledge as at the priority date of the application.

There are three main drilling technologies which are used in blast hole drilling operations: rotary drilling (RD), percussion assisted rotary drilling (PARD) and down the hole hammer (DTHH) drilling. These drilling techniques have long been known and widely used in open cast mines, quarrying and rock excavation applications. The type of drilling technique used is typically determined by the rock strength, with RD techniques being considered more economic for soft rocks and DTHH techniques being considered more economic for harder rocks. Each of these drilling methods have different power requirements and the drilling rig used must be able to meet these requirements. Whilst each of these drilling methods can typically be performed by a single rig, there are limitations.

The main limitation of operating both RD and DTHH from a single drilling rig is the drill hole diameter. In order to drive a rotary bit at larger diameters, a high pulldown rotation torque capacity drilling rig is required. Such drilling rigs also need to provide a relatively high volume of fluid to the drill pipe to flush away the broken rock drill cuttings. Alternatively, large diameter DTHH drilling rigs do not require the same high pulldown and rotation torque capacity, but do require a source of high pressure fluid to drive the DTHH. When drilling at diameters above approximately 200 mm, conventional drilling rigs do not have sufficient capacity to meet the fluid requirements of both RD and DTHH techniques. Separate drilling rigs for large diameter RD and DTHH drilling are therefore required. This presents problems to drilling operations using a single type of drilling rig to drill hole diameters greater than about 200 mm where both soft and hard rock formations are encountered.

Despite the disadvantages of using RD in hard rocks, drilling of holes beyond a diameter of approximately 200 mm in areas where both soft and hard rock formations are encountered will typically make use of RD. In such operations, the drilling rigs will need to be provided with sufficient pulldown and rotation torque capacity to drive the RD through the hard rock formations. These requirements increase both capital costs and the operational costs for large RD drilling rigs. Furthermore, significant wear may be experienced by the rotary drill bit when it encounters hard rock formations which results in the need for more frequent replacement. Given the high price of each drill bit and associated drilling consumable items, operating costs are significantly increased.

Whilst the use of DTHH drilling when hard rock is encountered would be more economical, the currently available drill rigs used for large diameter RD are not ideally suited to efficiently power large diameter (>200 mm) DTHH drills. This typically requires the use of a second drilling rig, which in most instances results in less than optimal effective utilisation of both types of drill rigs (RD & DTHH) and has a high capital and operating cost base through having underutilised assets.

Throughout this specification, unless the context requires otherwise, the word "comprise" or variations such as "comprises" or "comprising", will be understood to imply the inclusion of a stated integer or group of integers but not the exclusion of any other integer or group of integers.

SUMMARY OF INVENTION

In accordance with a first aspect of the present invention, there is provided a multipurpose drill system, the multipurpose drill system comprising:

a drilling rig adapted to drive a drilling assembly;

two or more power sources, wherein at least one of the two or more power sources is a high pressure power source, wherein the drilling assembly is adapted to be in communication with one or more of the power sources.

Preferably, the power sources are selected from high pressure power sources and low pressure power sources.

As would be appreciated by a person skilled in the art, drilling techniques require a fluid stream for operation. Throughout this specification, unless the context requires otherwise, the terms "power source", "low pressure power source" and "high pressure power source", will each be understood to refer to an apparatus that will receive a fluid stream and output a fluid stream at an increased pressure.

Throughout this specification, unless the context requires otherwise, the term "drilling assembly" or variations thereof, will be understood to refer to an apparatus that engages with the forward end of a drill string to retain and operate a drill bit. Example drilling assemblies include RD assemblies, PARD assemblies and DTHH assemblies. Components that are included in the drilling assemblies include drill bits, sleeves, drive subs, lock rings, pistons, drill pipes and other components required to operate each different assembly.

Conventional drilling techniques require a fluid stream for operation. This fluid stream is provided to the drilling assembly to flush cuttings from a hole being drilled and in some cases operate the drill assembly. As would be appreciated by a person skilled in the art, different drilling techniques have different operating requirements for this fluid stream. These requirements include minimum pressures and minimum volume throughput or flow rates.

Throughout this specification, unless the context requires otherwise, the term "high pressure power source", will be understood to refer to an apparatus that produces a fluid stream with specifications suitable to efficiently operate DTHH drilling techniques. When the fluid stream is compressed air, high pressure power sources are generally understood to produce compressed air at a greater than 10 bar.

Throughout this specification, unless the context requires otherwise, the term "low pressure power source", will be understood to refer to an apparatus that produces a fluid stream with specifications suitable to operate RD and PARD drilling techniques. When the fluid stream is compressed air, low pressure power sources are generally understood to produce compressed air at a volume of at least 15 $m^3$/min at a pressure of less than 10 bar.

In one embodiment of the present invention, the two or more power sources comprise at least one high pressure power source and at least one low pressure power source.

In one embodiment the present invention, the two or more power sources are each high pressure power sources.

In accordance with a first embodiment of the present invention, there is provided a multipurpose drill system, the multipurpose drill system comprising:

a drilling rig adapted to drive a drilling assembly;

at least one high pressure power source; and at least one low pressure power source, wherein the drilling assembly is adapted to be in communication with either or both of the at least one high pressure power source and the at least one low pressure power source.

In one form of the present invention, where the fluid is a liquid, each of the high pressure power source and the low pressure power source will be pump apparatus.

In an alternative form of the present invention, where the fluid is a gas, each of the at least one high pressure power source and the at least one low pressure power source will be compressor apparatus. Preferably, each of the at least one high pressure power source and the at least one low pressure power source are air compressors.

In one form of the present invention, where the at least one high pressure power source is an air compressor, the air compressor is a single stage or multi-stage air compressor.

In one form of the present invention, where the at least one high pressure power source is an air compressor, the air compressor is a positive or variable displacement type air compressor. Preferably, the air compressor is selected from the group comprising: piston-type compressors, reciprocating compressors, compound compressors, rotary-screw compressors, rotary vane compressors, scroll compressors and turbo compressors.

In one form of the present invention, where the at least one low pressure power source is an air compressor, the air compressor is a single stage or multi-stage air compressor.

In one form of the present invention, where the at least one low pressure power source is an air compressor, the air compressor is a positive or variable displacement type air compressor. Preferably, the air compressor is selected from the group comprising: piston-type compressors, reciprocating compressors, compound compressors, rotary-screw compressors, rotary vane compressors, scroll compressors and turbo compressors.

In one form of the present invention, the at least one high pressure power source is adapted to increase the pressure of the fluid produced by at least one low pressure power source.

In one embodiment, the at least one high pressure power source is capable of providing a supply of compressed air with a pressure of at least 10 Bar. In one embodiment, the at least one high pressure power source is capable of providing a supply of compressed air with a pressure of at least 11 Bar. In one embodiment, the at least one high pressure power source is capable of providing a supply of compressed air with a pressure of at least 12 Bar. In one embodiment, the at least one high pressure power source is capable of providing a supply of compressed air with a pressure of at least 13 Bar. In one embodiment, the at least one high pressure power source is capable of providing a supply of compressed air with a pressure of at least 14 Bar. In one embodiment, the at least one high pressure power source is capable of providing a supply of compressed air with a pressure of at least 15 Bar. In one embodiment, the at least one high pressure power source is capable of providing a supply of compressed air with a pressure of at least 16 Bar. In one embodiment, the at least one high pressure power source is capable of providing a supply of compressed air with a pressure of at least 17 Bar. In one embodiment, the at least one high pressure power source is capable of providing a supply of compressed air with a pressure of at least 18 Bar. In one embodiment, the at least one high pressure power source is capable of providing a supply of compressed air with a pressure of at least 19 Bar. In one embodiment, the at least one high pressure power source is capable of providing a supply of compressed air with a pressure of at least 20 Bar. In one embodiment, the at least one high pressure power source is capable of providing a supply of compressed air with a pressure of at least 21 Bar. In one embodiment, the at least one high pressure power source is capable of providing a supply of compressed air with a pressure of at least 22 Bar. In one embodiment, the at least one high pressure power source is capable of providing a supply of compressed air with a pressure of at least 23 Bar. In one embodiment, the at least one high pressure power source is capable of providing a supply of compressed air with a pressure of at least 24 Bar. In one embodiment, the at least one high pressure power source is capable of providing a supply of compressed air with a pressure of at least 25 Bar. In one embodiment, the at least one high pressure power source is capable of providing a supply of compressed air with a pressure of at least 26 Bar. In one embodiment, the at least one high pressure power source is capable of providing a supply of compressed air with a pressure of at least 27 Bar. In one embodiment, the at least one high pressure power source is capable of providing a supply of compressed air with a pressure of at least 28 Bar. In one embodiment, the at least one high pressure power source is capable of providing a supply of compressed air with a pressure of at least 29 Bar. In one embodiment, the at least one high pressure power source is capable of providing a supply of compressed air with a pressure of at least 30 Bar. In one embodiment, the at least one high pressure power source is capable of providing a supply of compressed air with a pressure of at least 31 Bar. In one embodiment, the at least one high pressure power source is capable of providing a supply of compressed air with a pressure of at least 32 Bar. In one embodiment, the at least one high pressure power source is capable of providing a supply of compressed air with a pressure of at least 33 Bar. In one embodiment, the at least one high pressure power source is capable of providing a supply of compressed air with a pressure of at least 34 Bar.

In one embodiment of the present invention, the or each high pressure power source is capable of providing a supply of compressed air with a maximum volume of 100 $m^3$/min at 10 bar. In one embodiment, the or each high pressure power source is capable of providing a supply of compressed air with a maximum volume of 90 $m^3$/min at 10 bar In one embodiment, the or each high pressure power source is capable of providing a supply of compressed air with a maximum volume of 80 $m^3$/min at 10 bar In one embodiment, the or each high pressure power source is capable of providing a supply of compressed air with a maximum volume of 70 $m^3$/min at 10 bar In one embodiment, the or each high pressure power source is capable of providing a supply of compressed air with a maximum volume of 60 $m^3$/min at 10 bar In one embodiment, the or each high pressure power source is capable of providing a supply of compressed air with a maximum volume of 50 $m^3$/min at 10 bar.

In one embodiment of the present invention, the at least one low pressure power source is capable of providing a supply of compressed air with a volume of at least 15 $m^3$/min at a pressure less than 10 bar. In one embodiment, the at least one low pressure power source is capable of providing a supply of compressed air with a volume of at least 20 $m^3$/min at a pressure less than 10 bar. In one embodiment, the at least one low pressure power source is capable of providing a supply of compressed air with a volume of at least 25 $m^3$/min at a pressure less than 10 bar. In one embodiment, the at least one low pressure power source is capable of providing a supply of compressed air with a volume of at least 30 $m^3$/min at a pressure less than 10 bar. In one embodiment, the at least one low pressure power source is capable of providing a supply of compressed air with a volume of at least 35 $m^3$/min at a pressure less than 10 bar. In one embodiment, the at least one low pressure power source is capable of providing a supply of compressed air with a volume of at least 40 $m^3$/min at a pressure less than 10 bar. In one embodiment, the at least one low pressure power source is capable of providing a supply of compressed air with a volume of at least 45 $m^3$/min at a pressure less than 10 bar. In one embodiment, the at least one low pressure power source is capable of providing a supply of compressed air with a volume of at least 50 $m^3$/min at a pressure less than 10 bar. In one embodiment, the at least one low pressure power source is capable of providing a supply of compressed air with a volume of at least 55 $m^3$/min at a pressure less than 10 bar. In one embodiment, the at least one low pressure power source is capable of providing a supply of compressed air with a volume of at least 60 $m^3$/min at a pressure less than 10 bar. In one embodiment, the at least one low pressure power source is capable of providing a supply of compressed air with a volume of at least 65 $m^3$/min at a pressure less than 10 bar. In one embodiment, the at least one low pressure power source is capable of providing a supply of compressed air with a volume of at least 70 $m^3$/min at a pressure less than 10 bar. In one embodiment, the at least one low pressure power source is capable of providing a supply of compressed air with a volume of at least 75 $m^3$/min at a pressure less than 10 bar. In one embodiment, the at least one low pressure power source is capable of providing a supply of compressed air with a volume of at least 80 $m^3$/min at a pressure less than 10 bar. In one embodiment, the at least one low pressure power source is capable of providing a supply of compressed air with a volume of at least 85 $m^3$/min at a pressure less than 10 bar. In one embodiment, the at least one low pressure power source is capable of providing a supply of compressed air with a volume of at least 90 $m^3$/min at a pressure less than 10 bar. In one embodiment, the at least one low pressure power source is capable of providing a supply of compressed air with a volume of at least 95 $m^3$/min at a pressure less than 10 bar. In one embodiment, the at least one low pressure power source is capable of providing a supply of compressed air with a volume of at least 100 $m^3$/min at a pressure less than 10 bar. In one embodiment, the at least one low pressure power source is capable of providing a supply of compressed air with a volume of at least 105 $m^3$/min at a pressure less than 10 bar. In one embodiment, the at least one low pressure power source is capable of providing a supply of compressed air with a volume of at least 110 $m^3$/min at a pressure less than 10 bar.

In one embodiment, the at least one low pressure power source is capable of providing a supply of compressed air with a maximum pressure of about 10 Bar.

In one form of the present invention, the multipurpose drill system further comprises at least one hydraulic pump mechanism adapted to supply hydraulic fluid for the operation of the drilling rig.

In one form of the present invention, the multipurpose drill system further comprises at least one engine to power the at least one high pressure power source and the at least one low pressure power source. Preferably, the engine is a combustible engine, an electric engine or a hybrid engine.

In one form of the present invention, the drilling rig is adapted to interchangeably receive one or more drilling assemblies. Preferably, the drilling assemblies are selected from rotary drilling assemblies, percussion assisted rotary drilling assemblies and down the hole hammer drilling assemblies. As would be appreciated by a person skilled in the art, the drilling assembly may be selected depending on the rock hardness to be drilled and other factors.

In one form of the present invention, the multipurpose drill system further comprises a drill assembly handling mechanism. Preferably, the drill assembly handling mechanism is adapted to remove and replace the drilling assembly. More preferably, the drill assembly handling mechanism is mounted on the drilling rig.

In one form of the present invention, the at least one high pressure power source and the at least one low pressure power source operate independently.

In one form of the present invention, where more than one high pressure power source is used, two or more high pressure power sources operate independently of the at least one low pressure power source.

In one form of the present invention, where more than one low pressure power source is used, two or more low pressure power sources operate independently of the at least one high pressure power source.

Preferably, the drilling assembly is adapted to be selectively switched between communication with the at least one high pressure power source and the at least one low pressure power source. More preferably, the drilling assembly is adapted to be selectively switched between communication with the at least one high pressure power source, the at least one low pressure power source, and both the at least one high pressure power source and the at least one low pressure power source simultaneously. Preferably, each the at least one high pressure power source and the at least one low pressure power sources feed into a manifold. More preferably, air input into the manifold is through a one way non-return valve. This has been found to prevent the power sources from receiving pressure signals for the other compressors which can affect how they load and unload. The manifold is designed to handle the maximum pressure and air volume flow that the at least one high pressure power source and the at least one low pressure power sources can deliver.

In one form of the present invention, the multipurpose drill system comprises two or more engines. Preferably, at least one engine independently powers the at least one hydraulic pump mechanism and at least one engine independently powers the at least one high pressure power source and at least one low pressure power source.

In one form of the present invention, at least one engine independently powers the at least one high pressure power source and at least one engine independently powers the at least one low pressure power source.

In one form of the present invention, the multipurpose drill system comprises three or more engines. Preferably, at least one engine independently powers the at least one hydraulic pump mechanism, at least one engine independently powers the at least one high pressure power source and at least one engine independently powers the at least one low pressure power source. Still preferably, at least one engine independently powers each high pressure power source and at least one engine independently powers each low pressure power source.

In one form of the present invention, the multipurpose drill system is mounted on a rig platform. Preferably, the multipurpose drill system is mounted on a single rig platform. More preferably, the rig platform is mobile. Still preferably, the rig platform is supported on a crawler undercarriage.

In one form of the present invention, the drilling rig comprises a drill head for rotating a drill pipe. Preferably, the at least one high pressure power source and at least one low pressure power source are in communication with the drill head for delivery of fluid to the drill pipe. More preferably, the fluid is compressed air.

In one form of the present invention, the drilling assembly comprises a drill pipe and drill bit.

In one form of the present invention, where the drilling assembly is a rotary drilling assembly, compressed air is used to flush the drill cuttings. Preferably, the compressed air is provided to the rotary drilling assembly by the low pressure power source.

In one form of the present invention, where the drilling assembly is a down the hole hammer drilling assembly, compressed air is used to actuate the percussion drilling assembly and flush the cuttings. Preferably, the compressed air is provided to the down the hole hammer drilling assembly by the high pressure power source.

In one form of the present invention, where the drilling assembly is a percussion assisted rotary drilling assembly, compressed air is used to actuate the hammer and flush the cuttings. Preferably, the compressed air is provided by the low pressure power source.

In one form of the present invention, the drilling rig further comprises a drill mast. Preferably, the drill mast is mounted on the drill rig. More preferably, the drill mast is adapted to tilt relative to the drill rig.

Preferably, the drill mast is adapted to support the drill head. In one form of the present invention, the drill mast further comprises a hoist for moving the drill pipe and drilling assembly longitudinally along the drill mast.

In one form of the present invention, the hydraulic pump mechanism comprises one or more hydraulic pumps. Preferably, the at least one hydraulic pumps supply hydraulic fluid under pressure to drive the drilling rig operations.

In one form of the present invention, the multipurpose drill system is adapted to drill holes with a diameter greater than 200 mm in diameter.

In one form of the present invention, the multipurpose drill system is adapted to drill holes with a diameter between 200-450 mm.

In one form of the present invention, the multipurpose drill system is adapted to drill holes in rock with a hardness of greater than 200 MPa. More preferably, the multipurpose drill system is adapted to drill holes in rock with a hardness of greater than 200 MPa and up to 800 MPa.

In accordance with a second embodiment of the present invention, there is provided a multipurpose drill system, the multipurpose drill system comprising:

a drilling rig adapted to drive a drilling assembly; and two or more high pressure power sources, wherein the drilling assembly is adapted to be in communication with either or both of the two or more high pressure power sources.

As discussed previously, the term "high pressure power source", will be understood to refer to an apparatus that produces a fluid stream with specifications suitable to operate DTHH drilling techniques. When the fluid stream is compressed air, high pressure power sources are generally understood to produce compressed air at a pressure of more than 10 bar. The maximum volume of air produced by high pressure power sources is however typically less that what is considered to be sufficient to efficiently operate RD and PARD drilling. In this embodiment of the present invention, the inventors have found that two or more high pressure power sources may be provided on the drilling rig and be operated simultaneously to provide a fluid stream at a volume suitable to operate RD drilling techniques.

In one form of the present invention, where the fluid is a liquid, each of the high pressure power sources will be pump apparatus.

In an alternative form of the present invention, where the fluid is a gas, each of the two of more high pressure power sources are compressor apparatus. Preferably, two or more high pressure power sources are air compressors.

In one form of the present invention, where the two or more high pressure power sources are air compressors, the air compressors are each a single stage or multi-stage air compressor.

In one form of the present invention, where the two or more high pressure power sources are air compressors, the air compressors are positive or variable displacement type air compressors. Preferably, the air compressors are selected from the group comprising: piston-type compressors, reciprocating compressors, compound compressors, rotary-screw compressors, rotary vane compressors, scroll compressors and turbo compressors.

In one form of the present invention, one or each high pressure power source is adapted to increase the pressure of the fluid produced by at least one lower pressure power source. In this form of the present invention, the or each high pressure power source is used to boost the pressure of the fluid produced by the or each lower pressure power source In one embodiment, at least one of the two or more high pressure power sources is capable of providing a supply of compressed air with a pressure of at least 10 bar. In one embodiment, at least one of the two or more high pressure power sources is capable of providing a supply of compressed air with a pressure of at least 11 bar. In one embodiment, at least one of the two or more high pressure power sources is capable of providing a supply of compressed air with a pressure of at least 12 bar. In one embodiment, at least one of the two or more high pressure power sources is capable of providing a supply of compressed air with a pressure of at least 13 bar. In one embodiment, at least one of the two or more high pressure power sources is capable of providing a supply of compressed air with a pressure of at least 14 bar. In one embodiment, at least one of the two or more high pressure power sources is capable of providing a supply of compressed air with a pressure of at least 15 bar. In one embodiment, at least one of the two or more high pressure power sources is capable of providing a supply of compressed air with a pressure of at least 16 bar. In one embodiment, at least one of the two or more high pressure power sources is capable of providing a supply of compressed air with a pressure of at least 17 bar. In one embodiment, at least one of the two or more high pressure power sources is capable of providing a supply of compressed air with a pressure of at least 18 bar. In one embodiment, at least one of the two or more high pressure power sources is capable of providing a supply of compressed air with a pressure of at least 19 bar. In one embodiment, at least one of the two or more high pressure power sources is capable of providing a supply of compressed air with a pressure of at least 20 bar. In one embodiment, at least one of the two or more high pressure power sources is capable of providing a supply of compressed air with a pressure of at least 21 bar. In one embodiment, at least one of the two or more high pressure power sources is capable of providing a supply of compressed air with a pressure of at least 22 bar. In one embodiment, at least one of the two or more high pressure power sources is capable of providing a supply of compressed air with a pressure of at least 23 bar. In one embodiment, at least one of the two or more high pressure power sources is capable of providing a supply of compressed air with a pressure of at least 24 bar. In one embodiment, at least one of the two or more high pressure power sources is capable of providing a supply of compressed air with a pressure of at least 25 bar. In one embodiment, at least one of the two or more high pressure power sources is capable of providing a supply of compressed air with a pressure of at least 26 bar. In one embodiment, at least one of the two or more high pressure power sources is capable of providing a supply of compressed air with a pressure of at least 27 bar. In one embodiment, at least one of the two or more high pressure power sources is capable of providing a supply of compressed air with a pressure of at least 28 bar. In one embodiment, at least one of the two or more high pressure power sources is capable of providing a supply of compressed air with a pressure of at least 29 bar. In one embodiment, at least one of the two or more high pressure power sources is capable of providing a supply of compressed air with a pressure of at least 30 bar. In one embodiment, at least one of the two or more high pressure power sources is capable of providing a supply of compressed air with a pressure of at least 31 bar. In one embodiment, at least one of the two or more high pressure power sources is capable of providing a supply of compressed air with a pressure of at least 32 bar. In one embodiment, at least one of the two or more high pressure power sources is capable of providing a supply of compressed air with a pressure of at least 33 bar. In one embodiment, at least one of the two or more high pressure power sources is capable of providing a supply of compressed air with a pressure of at least 34 bar. In one embodiment, at least one of the two or more high pressure power sources provides a supply of compressed air with a pressure of at least 35 bar. In one embodiment, at least one of the two or more high pressure power sources provides a supply of compressed air with a pressure of at least 36 bar. In one embodiment, at least one of the two or more high pressure power sources provides a supply of compressed air with a pressure of at least 37 bar. In one embodiment, at least one of the two or more high pressure power sources provides a supply of compressed air with a pressure of at least 38 bar. In one embodiment, at least one of the two or more high pressure power sources provides a supply of compressed air with a pressure of at least 39 bar. In one embodiment, at least one of the two or more high pressure power sources provides a supply of compressed air with a pressure of at least 40 Bar.

In one embodiment, each high pressure power source is capable of providing a supply of compressed air with a maximum volume of 100 $m^3$/min at 10 bar. In one embodiment, each high pressure power source is capable of providing a supply of compressed air with a maximum volume of 90 $m^3$/min at 10 bar. In one embodiment, each high pressure power source is capable of providing a supply of compressed air with a maximum volume of 80 $m^3$/min at 10 bar. In one embodiment, each high pressure power source is capable of providing a supply of compressed air with a maximum volume of 70 $m^3$/min at 10 bar. In one embodiment, each high pressure power source is capable of providing a supply of compressed air with a maximum volume of 60 $m^3$/min at 10 bar. In one embodiment, each high pressure power source is capable of providing a supply of compressed air with a maximum volume of 50 $m^3$/min at 10 bar.

In one embodiment of the present invention, the two or more high pressure power sources are capable of providing a supply of compressed air with a volume of at least 15 $m^3$/min at a pressure less than 10 bar when operated simultaneously. In one embodiment, the two or more high pressure power sources are capable of providing a supply of compressed air with a volume of at least 20 $m^3$/min at a pressure less than 10 bar when operated simultaneously. In one embodiment, the two or more high pressure power sources are capable of providing a supply of compressed air with a volume of at least 25 $m^3$/min at a pressure less than 10 bar when operated simultaneously. In one embodiment, the two or more high pressure power sources are capable of providing a supply of compressed air with a volume of at least 30 $m^3$/min at a pressure less than 10 bar when operated simultaneously. In one embodiment, the two or more high pressure power sources are capable of providing a supply of compressed air with a volume of at least 35 $m^3$/min at a pressure less than 10 bar when operated simultaneously. In one embodiment, the two or more high pressure power sources are capable of providing a supply of compressed air with a volume of at least 40 $m^3$/min at a pressure less than 10 bar when operated simultaneously. In one embodiment, the two or more high pressure power sources are capable of providing a supply of compressed air with a volume of at least 45 $m^3$/min at a pressure less than 10 bar when operated simultaneously. In one embodiment, the two or more high pressure power sources are capable of providing a supply of compressed air with a volume of at least 50 $m^3$/min at a pressure less than 10 bar when operated simultaneously. In one embodiment, the two or more high pressure power sources are capable of providing a supply of compressed air with a volume of at least 55 $m^3$/min at a pressure less than 10 bar when operated simultaneously. In one embodiment, the two or more high pressure power sources are capable of providing a supply of compressed air with a volume of at least 60 $m^3$/min at a pressure less than 10 bar when operated simultaneously. In one embodiment, the two or more high pressure power sources are capable of providing a supply of compressed air with a volume of at least 65 $m^3$/min at a pressure less than 10 bar when operated simultaneously. In one embodiment, the two or more high pressure power sources are capable of providing a supply of compressed air with a volume of at least 70 $m^3$/min at a pressure less than 10 bar when operated simultaneously. In one embodiment, the two or more high pressure power sources are capable of providing a supply of compressed air with a volume of at least 75 $m^3$/min at a pressure less than 10 bar when operated simultaneously. In one embodiment, the two or more high pressure power sources are capable of providing a supply of compressed air with a volume of at least 80 $m^3$/min at a pressure less than 10 bar when operated simultaneously. In one embodiment, the two or more high pressure power sources are capable of providing a supply of compressed air with a volume of at least 85 $m^3$/min at a pressure less than 10 bar when operated simultaneously. In one embodiment, the two or more high pressure power sources are capable of providing a supply of compressed air with a volume of at least 90 $m^3$/min at a pressure less than 10 bar when operated simultaneously. In one embodiment, the two or more high pressure power sources are capable of providing a supply of compressed air with a volume of at least 95 $m^3$/min at a pressure less than 10 bar when operated simultaneously. In one embodiment, the two or more high pressure power sources are capable of providing a supply of compressed air with a volume of at least 100 $m^3$/min at a pressure less than 10 bar when operated simultaneously. In one embodiment, the two or more high pressure power sources are capable of providing a supply of compressed air with a volume of at least 105 $m^3$/min at a pressure less than 10 bar when operated simultaneously. In one embodiment, the two or more high pressure power sources are capable of providing a supply of compressed air with a volume of at least 110 $m^3$/min at a pressure less than 10 bar when operated simultaneously.

In one form of the present invention, the multipurpose drill system further comprises at least one hydraulic pump mechanism adapted to supply hydraulic fluid for the operation of the drilling rig.

In one form of the present invention, the multipurpose drill system further comprises at least one engine to power the two or more high pressure power sources.

In one form of the present invention, the drilling rig is adapted to interchangeably receive different drilling assemblies. Preferably, the drilling assemblies are selected from rotary drilling assemblies, percussion assisted rotary drilling assemblies and down the hole hammer drilling assemblies.

In one form of the present invention, the multipurpose drill system further comprises a drill assembly handling mechanism. Preferably, the drill assembly handling mechanism is adapted to remove and replace the drilling assembly. More preferably, the drill assembly handling mechanism is mounted on the drilling rig.

In one form of the present invention, each high pressure power source operates independently.

Preferably, the drilling assembly is adapted to be selectively switched between communication with each high pressure power source or two or more high pressure power sources simultaneously.

In one form of the present invention, the multipurpose drill system comprises two or more engines. Preferably, at least one engine independently powers the at least one hydraulic pump mechanism and at least one engine independently powers the two or more high pressure power sources.

In one form of the present invention, at least one engine independently powers each high pressure power source.

In one form of the present invention, the multipurpose drill system comprises three or more engines. Preferably, at least one engine independently powers the at least one hydraulic pump mechanism, at least one engine independently powers each high pressure power source.

In one form of the present invention, the multipurpose drill system is mounted on a rig platform. Preferably, the multipurpose drill system is mounted on a single rig platform. More preferably, the rig platform is mobile. Still preferably, the rig platform is supported on a crawler undercarriage.

In one form of the present invention, the drilling rig comprises a drill head for rotating a drill pipe. Preferably, the at least one high pressure power source and at least one low pressure power source are in communication with the drill head for delivery of fluid to the drill pipe. More preferably, the fluid is compressed air.

In one form of the present invention, the drilling assembly comprises a drill pipe and drill bit.

In one form of the present invention, where the drilling assembly is a rotary drilling assembly, compressed air is used to flush the cuttings. Preferably, the compressed air is provided to rotary drilling assembly by the two high pressure power sources operating simultaneously.

In one form of the present invention, where the drilling assembly is a down the hole hammer drilling assembly, compressed air is used to actuate the percussion assembly and flush the cuttings. Preferably, the compressed air is provided to the down the hole hammer drilling assembly by at least one of the two or more high pressure power sources.

In one form of the present invention, where the drilling assembly is a percussion assisted rotary drilling assembly, compressed air is used to actuate the hammer and flush the cuttings. Preferably, the compressed air is provided by the two or more high pressure power sources operating simultaneously. More preferably, the pressure of the compressed air provided by the two or more high pressure power sources is regulated to that required by the rotary drilling assembly. It is envisaged that the pressure may be regulated by a pressure regulator.

In one form of the present invention, the drilling rig further comprises a drill mast. Preferably, the drill mast is mounted on the drill rig. More preferably, the drill mast is adapted to tilt relative to the drill rig.

Preferably, the drill mast is adapted to support the drill head. In one form of the present invention, the drill mast further comprises a hoist for moving the drill pipe and drilling assembly longitudinally along the drill mast.

In one form of the present invention, the hydraulic pump mechanism comprises one or more hydraulic pumps. Preferably, the at least one hydraulic pumps supply hydraulic fluid under pressure to drive the drilling rig.

In one form of the present invention, the multipurpose drill system is adapted to drill holes with a diameter greater than 200 mm.

In one form of the present invention, the multipurpose drill system is adapted to drill holes with a diameter between 200-450 mm.

In one form of the present invention, the multipurpose drill system is adapted to drill holes in rock with a hardness of greater than 200 MPa. More preferably, the multipurpose drill system is adapted to drill holes in rock with a hardness of greater than 200 MPa and up to 800 MPa.

In accordance with a third aspect of the present invention, there is provided a method for drilling a hole, the method comprising the use of a multipurpose drill system in accordance with the present invention.

In one embodiment, the method for drilling comprises the drilling of holes with a diameter greater than 200 mm. In one embodiment, the method for drilling comprises the drilling of holes with a diameter greater than 210 mm. In one embodiment, the method for drilling comprises the drilling of holes with a diameter greater than 220 mm. In one embodiment, the method for drilling comprises the drilling of holes with a diameter greater than 230 mm. In one embodiment, the method for drilling comprises the drilling of holes with a diameter greater than 240 mm. In one embodiment, the method for drilling comprises the drilling of holes with a diameter greater than 250 mm. In one embodiment, the method for drilling comprises the drilling of holes with a diameter greater than 260 mm. In one embodiment, the method for drilling comprises the drilling of holes with a diameter greater than 270 mm. In one embodiment, the method for drilling comprises the drilling of holes with a diameter greater than 280 mm. In one embodiment, the method for drilling comprises the drilling of holes with a diameter greater than 290 mm. In one embodiment, the method for drilling comprises the drilling of holes with a diameter greater than 300 mm. In one embodiment, the method for drilling comprises the drilling of holes with a diameter greater than 310 mm. In one embodiment, the method for drilling comprises the drilling of holes with a diameter greater than 320 mm. In one embodiment, the method for drilling comprises the drilling of holes with a diameter greater than 330 mm. In one embodiment, the method for drilling comprises the drilling of holes with a diameter greater than 340 mm. In one embodiment, the method for drilling comprises the drilling of holes with a diameter greater than 350 mm. In one embodiment, the method for drilling comprises the drilling of holes with a diameter greater than 360 mm. In one embodiment, the method for drilling comprises the drilling of holes with a diameter greater than 370 mm. In one embodiment, the method for drilling comprises the drilling of holes with a diameter greater than 380 mm. In one embodiment, the method for drilling comprises the drilling of holes with a diameter greater than 390 mm. In one embodiment, the method for drilling comprises the drilling of holes with a diameter greater than 400 mm. In one embodiment, the method for drilling comprises the drilling of holes with a diameter greater than 410 mm. In one embodiment, the method for drilling comprises the drilling of holes with a diameter greater than 420 mm. In one embodiment, the method for drilling comprises the drilling of holes with a diameter greater than 430 mm. In one embodiment, the method for drilling comprises the drilling of holes with a diameter greater than 440 mm. In one embodiment, the method for drilling comprises the drilling of holes with a diameter greater than 450 mm.

In one form of the present invention, the method for drilling comprises the drilling of holes with a diameter between 200-450 mm. In one embodiment the method for drilling comprises the drilling of holes with a diameter between 229-450 mm. In one embodiment the method for drilling comprises the drilling of holes with a diameter between 250-450 mm In one form of the present invention, the method for drilling comprises the drilling of holes in rock with a hardness of greater than 200 MPa. In one embodiment, the method for drilling comprises the drilling of holes in rock with a hardness of greater than 250 MPa. In one embodiment, the method for drilling comprises the drilling of holes in rock with a hardness of greater than 300 MPa. In one embodiment, the method for drilling comprises the drilling of holes in rock with a hardness of greater than 350 MPa. In one embodiment, the method for drilling comprises the drilling of holes in rock with a hardness of greater than 400 MPa. In one embodiment, the method for drilling comprises the drilling of holes in rock with a hardness of greater than 450 MPa. In one embodiment, the method for drilling comprises the drilling of holes in rock with a hardness of greater than 500 MPa. In one embodiment, the method for drilling comprises the drilling of holes in rock with a hardness of greater than 550 MPa. In one embodiment, the method for drilling comprises the drilling of holes in rock with a hardness of greater than 600 MPa. In one embodiment, the method for drilling comprises the drilling of holes in rock with a hardness of greater than 650 MPa. In one embodiment, the method for drilling comprises the drilling of holes in rock with a hardness of greater than 700 MPa. In one embodiment, the method for drilling comprises the drilling of holes in rock with a hardness of greater than 750 MPa.

Preferably, the method for the drilling comprises the drilling of holes in rock with a hardness of greater than 200 MPa and up to 800 MPa.

Preferably, the method of drilling comprises rotary drilling, percussion assisted rotary drilling or down the hole hammer drilling. Preferably, the method drilling can switch between rotary drilling, percussion assisted rotary drilling or down the hole hammer drilling In one form of the present invention, where the method of drilling comprises rotary drilling, the method comprises the steps of:

fixing a RD assembly to the drilling rig;

providing communication between the RD assembly and at least one low pressure power source or two or more high pressure power sources; and operating the at least one low pressure power source or two or more high pressure power sources.

In one form of the present invention, where the method of drilling comprises percussion assisted rotary drilling, the method comprises the steps of:

fixing a PARD assembly to the drilling rig;

providing communication between the PARD assembly and at least one low pressure power source or two or more high pressure power sources; and operating the at least one low pressure power source or two or more high pressure power sources.

In one form of the present invention, where the method of drilling comprises down the hole hammer drilling, the method comprises the steps of:

fixing a DTHH assembly to the drilling rig;

providing communication between the DTHH assembly and at least one high pressure power source; and operating the at least one high pressure power sources.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

Figure 1:
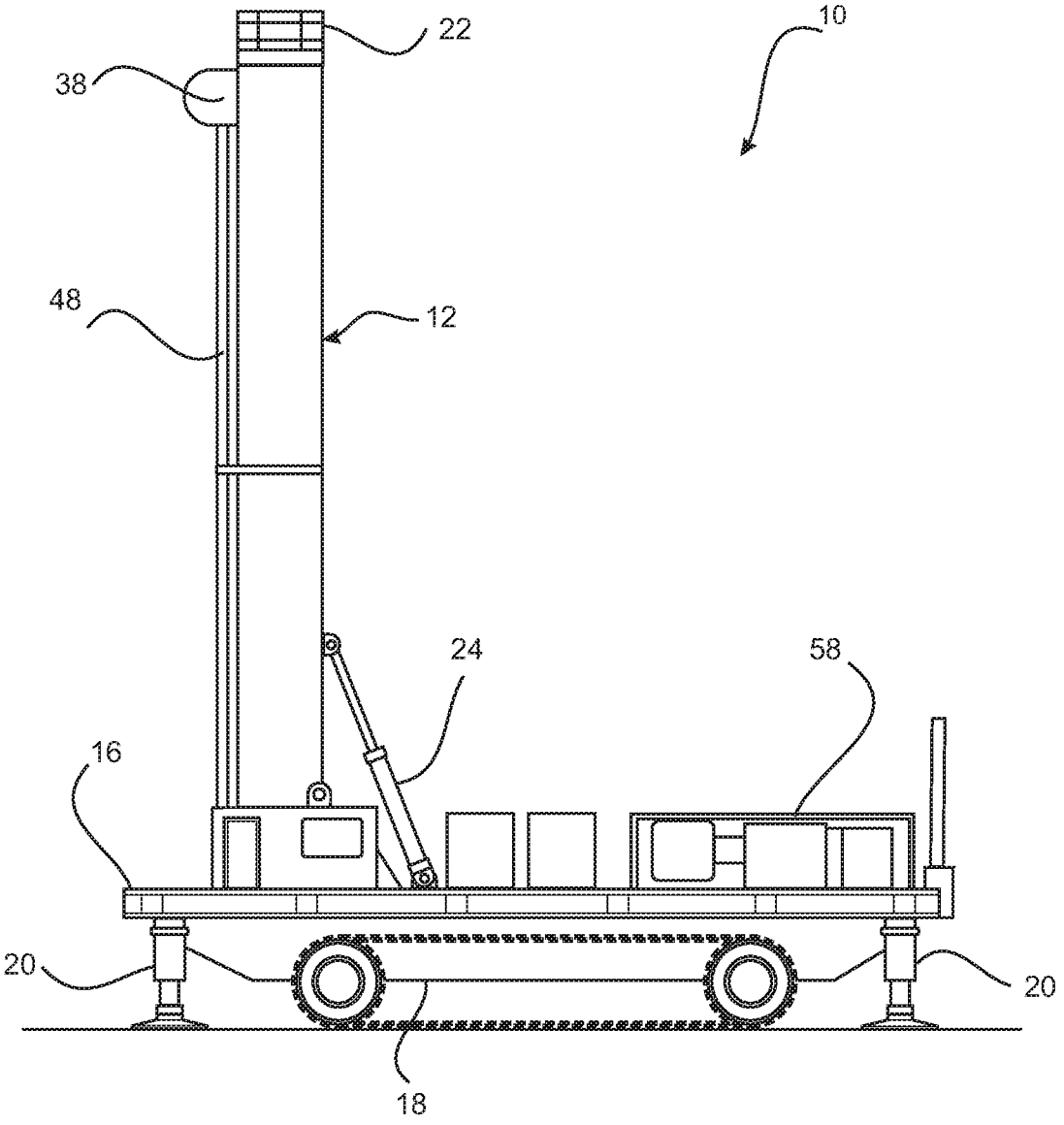
FIG. 1 is a diagrammatic side elevation view of drill rig incorporating the multipurpose drill system in accordance with the present invention, showing the drill mast in a drilling position.
Figure 2:
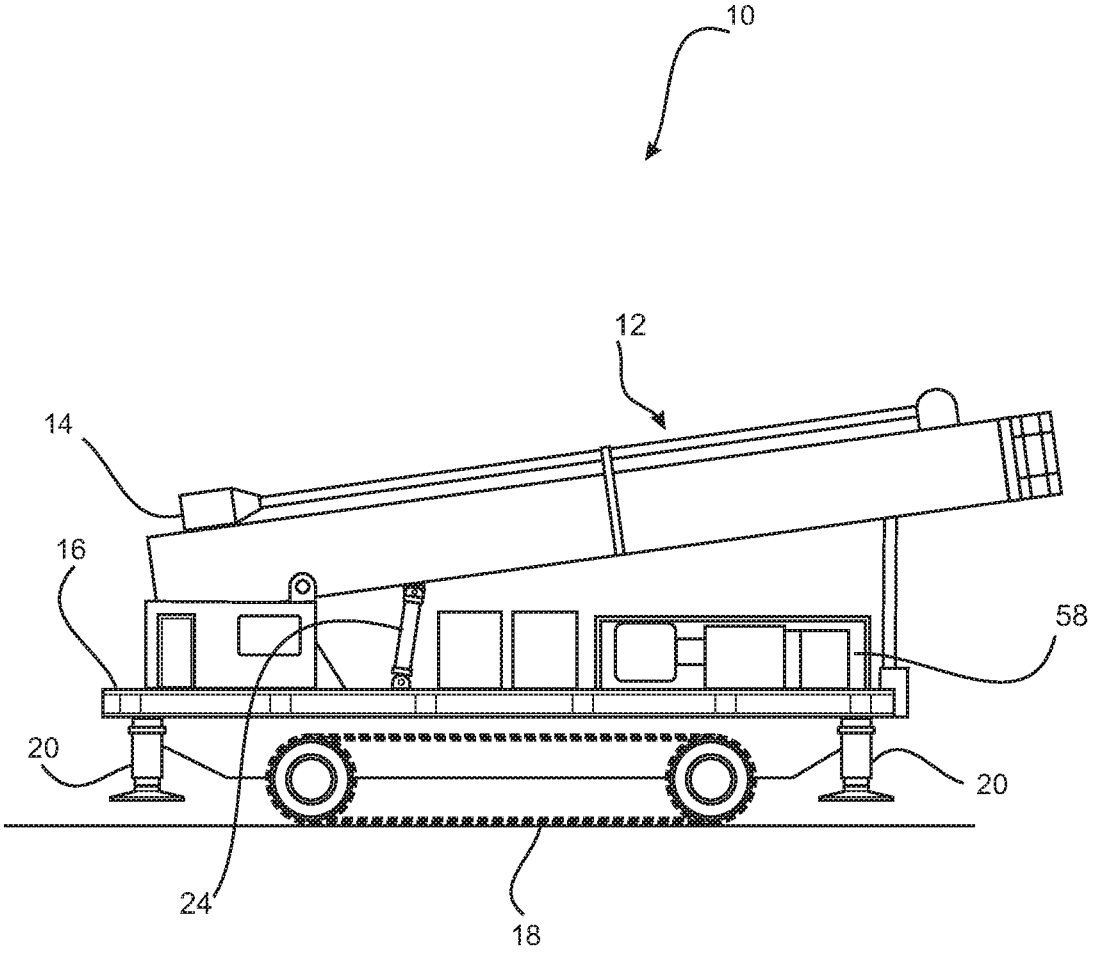
FIG. 2 is a diagrammatic side elevation view of the drill rig of FIG. 1, showing the drill mast in a retracted position.

In FIGS. 1 and 2 there is shown a multipurpose drill system 10 in accordance with one embodiment of the present invention. The multipurpose drill system 10 comprises a drilling rig 12 which is adapted to drive a drilling assembly 14 that drills a borehole into the ground.

In the embodiment shown in FIG. 2, the multipurpose drill system 10 is supported on a rig platform 16. The rig platform 16 is supported on a crawler undercarriage 18 that allows the rig platform 16 to be positioned relative to the area to be drilled. The rig platform 16 further comprises levelling jacks 20 that may be positioned to provide stability when drilling.

The drilling rig 12 includes a drill mast 22 which is hinged to the rig platform 16, such that the drill mast 22 is able to tilt relative to the rig platform 16. In the arrangement shown in FIGS. 1 and 2, the drill mast 22 is able to move from a vertical positon for drilling at varying angles to a horizontal position. The horizontal positon allows for the transport of the rig platform 16. Hydraulic actuators 24 shown in FIGS. 1 and 2 control the movement of the drill mast 22.

The drilling rig 12 further comprises an operator cab 36 which houses the operating controls for the drilling operation, along with monitoring instruments. Whilst the embodiment shown in FIGS. 1 and 2 comprises an operator cab 36, it is envisaged that operation of the drilling rig 10 may be controlled autonomously. Where drilling is completed by autonomous drilling methods, it is envisaged that the operator cab 36 is used as a control room for remoted signalled drilling operations, along with monitoring instruments.

The drilling rig 12 comprises a drill head 38 supported within or on the drill mast 22. The drill head 38 is guided for longitudinal movement along the drill mast 22. Movement of the drill head 38 is controlled by a hoist (not shown). Hydraulic head actuators (not shown) control the movement of the drill head 38 and the hoist. Whilst a drill head 38 shown in the Figures is adapted move along the drill mast 22, it is envisaged that other rotation drive mechanisms may be employed, such as for example a Table Drive. As would be understood by a person skilled in the art, where a Table Drive is utilised, it does not move along the drill mast 22.

The multipurpose drill system 10 further comprises a hydraulic pump mechanism 44 adapted to supply hydraulic fluid for hydraulic operations. The Hydraulic actuators 24 for tilting the drill mast 22, the drill head 38, the hoist and various other components of the drilling rig 12, are operated by the hydraulic fluid supplied by the hydraulic pump mechanism 44. The hydraulic pump mechanism 44 is operated by a diesel engine 46 mounted on the rig platform 16.

Figure 3:
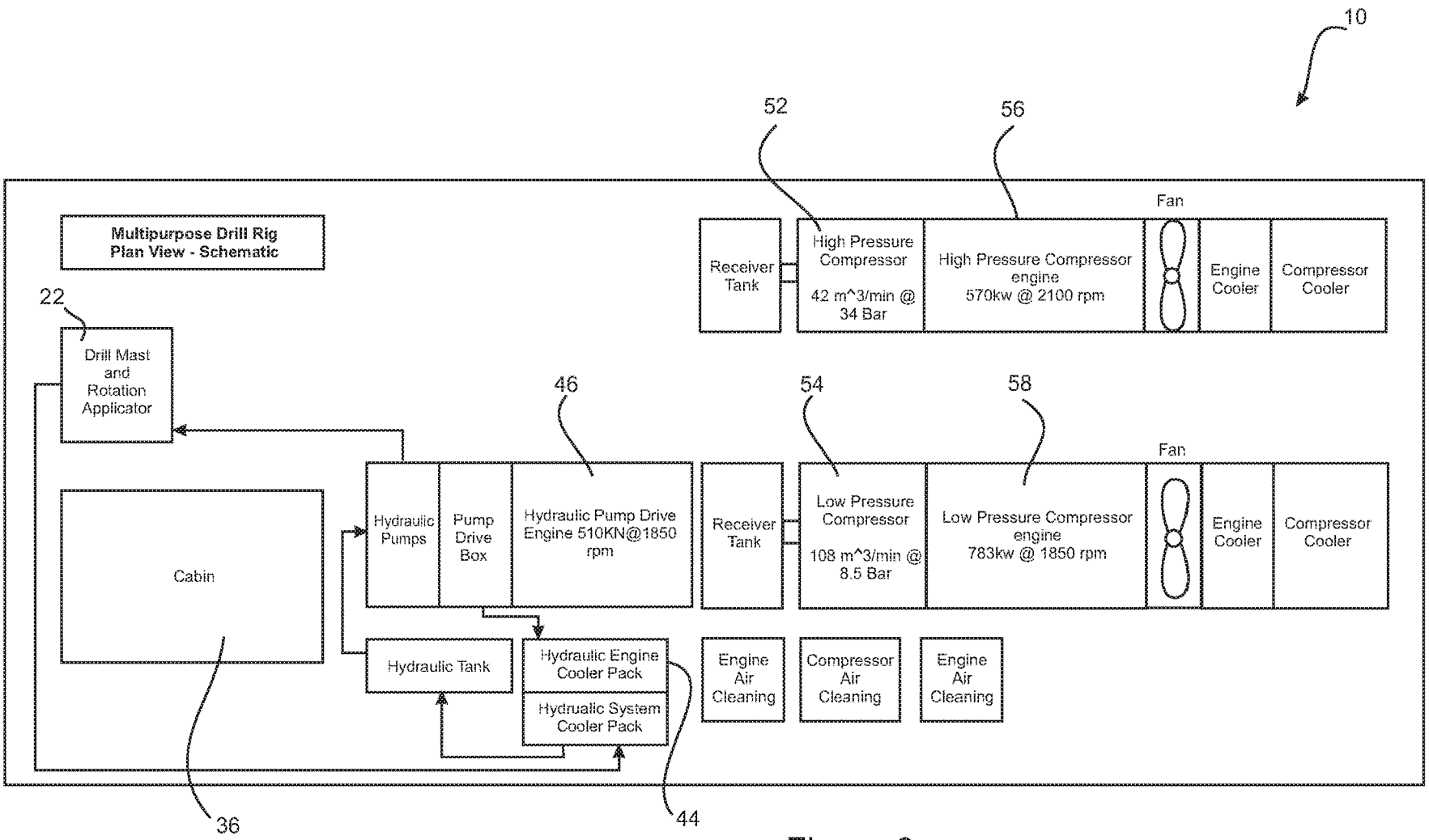
FIG. 3 is a schematic representation of the multipurpose drill system in accordance with a first embodiment of the present invention.

With reference to FIG. 3, the drilling rig 12 is adapted to interchangeably receive different drilling assemblies, such as a rotary drilling (RD) assembly, a percussion assisted rotary drilling (PARD) assembly or a down the hole hammer (DTHH) drilling assembly 14. Each of these drilling assemblies comprise a drill pipe 48 that engages with the drill head 38. This engagement permits the rotation of the drill pipe 48 by the drill head 38. The drill pipe 48 is made up by connecting lengths of pipe supplied from a drill pipe carousel or rod bin/rack by means of a transfer mechanism (not shown). The transfer mechanism is operated by hydraulic actuators. As would be understood by a person skilled in the art, each drilling assembly 14 operates in a different manner.

Typical RD assemblies employ a rotational drill bit at the end of the drill pipe 48 to cut or crushing/grinding into the formation. Both rotational forces and downward pressure must be exerted on the drill bit to drive it through the formation. The rotation and pressure is exerted on the drill bit by the drill head 38. As the drilling continues, a fluid stream such as compressed air or a liquid is sent down the drill pipe 48 to flush and clear the cuttings from within the borehole.

Typical DTHH drilling assemblies operate by providing a hammer assembly at the end of the drill pipe 48 to chip away rock and produce a hole. The hammer assembly comprises a pneumatic or hydraulic percussion mechanism, commonly called the hammer, which is located directly behind a drill bit. The pneumatic or other fluid (hydraulic) percussion mechanism strikes the impact surface of the bit directly to drive the drill bit into the rock. Compressed air or another fluid is provided down the drill pipe 48 to actuate the pneumatic hammer and to flush out the cutting. The drill pipe 48 transmits the necessary feed force and rotation to hammer and bit.

Typical PARD drilling assemblies use both rotary and low(er) percussive action in order to chip away rock during the RD application and produce a hole. The combination of rotation and percussion helps the drill achieve a cutting/crushing and grinding (rotary) action at the same time as a chipping (percussive) action. Usually these motions are hydraulically or pneumatically driven. A hole is formed when the power source is transmitted through the drill pipe 48 to the drill bit.

In FIG. 3, there is shown a multipurpose drill system 10 in accordance with a first embodiment of the present invention. In this embodiment, the multipurpose drill system 10 further comprises a high pressure power source, such as a high pressure compressor 52 and a low pressure power source, such as a low pressure compressor 54 mounted on the drilling rig 12. Each of the compressors 52; 54 are adapted to provide compressed air to the drilling rig 12 and down the drill pipe 48. In the embodiment shown in the figures, the high pressure compressor 52 is powered by a first engine 56 and the low pressure compressor 54 is powered by a second engine 58. The first and second engines 56; 58 allow the independent operation of each of the high pressure compressor 52 and the low pressure compressor 54.

As would be appreciated by a person skilled in the art, a compressor is a mechanical device that increases the pressure of a gas by reducing its volume. Air compressors typically operate by forcing air into a storage tank, thereby increasing the pressure of that air. The compressed air is held in the tank for use. There are many different types of compressors that are available to the skilled addressee and these include piston-type compressors, reciprocating compressors, compound compressors, rotary-screw compressors, rotary vane compressors, scroll compressors and turbo compressors.

As would be understood by a person skilled in the art, each drilling assembly 14 has different power source requirements. DTHH drill assemblies require high pressure fluid, but do not require as high volumes of fluid as rotary or PARD drilling techniques for the same drill hole diameter. Conversely, RD drilling assemblies require a high volume of low pressure fluid to clear the cutting, but the required pressure is not as high as for DTHH drilling. The inventors have determined that the requirements for each drilling assembly 14 can be provided independently by either a high pressure power source, for example the high pressure compressor 52 or a low pressure power source, for example the low pressure compressor 54. As separate engines 56; 58 are used to power each power source, it is envisaged that the specification of the each engine can be matched to the requirements of the power source.

The inventors have determined that the use of parallel low pressure and high pressure compressors 52; 54 on a single drilling rig 12 is particularly advantageous for the drilling of large diameter holes in formations that contain rock of varying hardness. As would be appreciated by a person skilled in the art, rotary drilling assemblies generally have a high penetration rate and are more economic for drilling in soft rocks. As such, rotary drilling assemblies are typically used for the drilling of large diameter holes into rock with a hardness of less than 200 MPa. However, the use of rotary drilling assemblies for the drilling of large diameter holes in hard rock requires a drilling rig 12 with high pull down and rotation capacity to drive the RD bit through the rock. This presents a significant capital expenditure for the high capacity drill rig itself, along with higher operating costs to power the compressor. Furthermore, the rotary drill bits may wear at a quicker rate, requiring ongoing replacement costs. These factors together contribute to a higher cost impediment to such operations. Unlike RD, DTHH drilling assemblies are generally more suited and more economic for drilling of hard rock material. Whilst DTHH drilling for such large diameter (up to and greater than 229 mm) hole drilling operations may be preferred, these assemblies require a significantly higher air pressure than RD assemblies and as such, is outside the capacity of conventional low pressure only RD rigs. To increase utility of some large capacity conventional low pressure only drill rigs, some PARD assemblies are used to provide percussive assistance to drill bits used in RD applications. Through this assistance drill penetration rates may be increased in hard rock thereby improved. Unlike conventional drilling systems, the multipurpose drill system 10 of the present invention provides the ability to support multiple large diameter drilling assemblies (up to and >than 229 mm) from a single drilling system. It is envisaged that such a system will allow for the ability to switch between RD, PARD, and DTHH drilling when material of different hardness is encountered.

In the embodiment shown in the figures, separate engines power each of the hydraulic pump mechanism 44, the high pressure compressor 52 and the low pressure compressor 54. It is envisaged that by having three separate engines, the overall operating cost may be reduced and drill rig output optimised to match the rock hardness for the required drill hole diameter. As discussed above, the compressed air requirements of each of the RD and DTHH drilling assemblies are significantly different. Accordingly, the loads experienced by engines operating compressors running to each of these specifications are also different. Whilst it is envisaged that a single engine may operate all of the hydraulic pump mechanism 44 and both the high pressure and low pressure compressors 52; 54, the inventors have determined that it is less efficient to run such an over specified engine. It is envisaged that the use of individual engines for each of the hydraulic pump mechanism 44 the high pressure compressor 52 and the low pressure compressor 54 will allow for the efficient energy use. Whilst the engine operating the hydraulic pump mechanism 44 would need to remain running to power the drill hydraulics, the first and second engines would not need to be running in tandem. They would only be called upon when their function is necessary.

The hydraulic pump mechanism 44 is powered by an engine of specific horsepower to function and operate the hydraulic requirements, for example a 570 kw @ 1850 rpm diesel engine. The preferred hydraulic pump mechanism 44 will provide an open circuit flow rate of approximately 3×425 l/min, a closed circuit flow rate of 2×125 l/min and max pressure of 320 bar.

In a highly preferred embodiment of the present invention, the high pressure compressor 52 is a double stage compressor that produces approximately 40 $m^3$/min. of compressed air at a pressure of ~35 bar. Those skilled in the art would be able to determine the appropriate engine to power the selected high pressure compressor 52, for example one suitable engine to power the high pressure compressor 52 is a ~570 kw @ 2100 rpm diesel engine.

In a highly preferred embodiment of the present invention, the low pressure compressor 54 is a single stage compressor that produces approximately 100 $m^3$/min. of compressed air at a pressure of ~7 bar. Those skilled in the art would be able to determine the appropriate engine to power the selected low pressure compressor 54, for example one suitable engine to power the low pressure compressor 54 is a ~780 kw @ 1850 rpm diesel engine.

In order to drive the RD assembly for drill hole diameters >200 mm in rock formation with a hardness of above ~200 MPa, the drill rig typically requires a pulldown capacity of at least 200 kN. The rotary head requires a minimum 10,000 nm rotation torque.

In use, it envisaged that the multipurpose drill system 10 will enable the operation of each of RD, DTHH drilling and PARD from a single drill rig. In operation, the rig will be positioned adjacent to the site where the hole is to be drilled. The support jacks 20 may be extended and the drill mast 22 will be moved to required hole angle positon. In typical drilling operations, the hardness of the rock at the surface is relatively softer than unweathered or stronger rock formations which may be present at greater depths and so a RD assembly will be fixed to the drill rig. During RD, the engine for the hydraulic pump mechanism 44 will be operated and the engine for the low pressure compressor 54 will be operated. The drilling will commence, with the drill head 38 driving the RD assembly through the rock with the cuttings being flushed out by the compressed air. As the drilling continues additional dill pipe sections may be added until the desired drill hole depth is reached, or the encountered rock hardness becomes uneconomic to drill using RD assemblies due to slow penetration rates or high drill bit wear/consumption.

When portion of rock formations with a greater hardness (~200 MPa) are encountered, the RD drilling ceases and the RD assembly is lifted from drill hole/drill pipe/rod. Once removed from the drill hole, the RD assembly is removed from the drilling rig 12 and is replaced by a DTHH assembly. It is envisaged that the removed assembly may be safely stored on the rig platform 16, thereby allowing it to be easily accessed when again required. The engine for the high pressure compressor 52 is operated and the compressed air is sent down the drill pipe 48 to the DTHH drilling assembly 14. Drilling may continue through the rock of greater hardness using the DTHH drilling assembly 14, with the compressed air from the high pressure compressor 52 being used to actuate the DTHH and flush out the cuttings or in application where large volumes of hard rock material are encountered over the entire designed drill hole length or drill hole array program.

Once the hard portion of the rock formation has been penetrated, the DTHH drilling assembly 14 may lifted from the hole and the RD assembly can once again be attached. RD through the soft rock may then continue, with the compressed air being supplied by the low pressure compressor 54. It is envisaged that hard rock formations could alternatively be encountered first, in which case the DTHH assembly will be attached first and replaced with the RD assembly when soft rock formations are encountered.

As would be appreciated by a person skilled in the art, blast hole drilling requires an array of holes to be drilled to a predetermined depth, for example 10-20 m. Across the array of holes, the hardness of the rock may vary. It is envisaged that the drilling assembly 10 of the present invention allows for the use of RD drilling techniques for portions where the rock hardness is less than about 200 MPa and DTHH drilling techniques for portions where the rock hardness is more than about 200 MPa.

Figure 4:
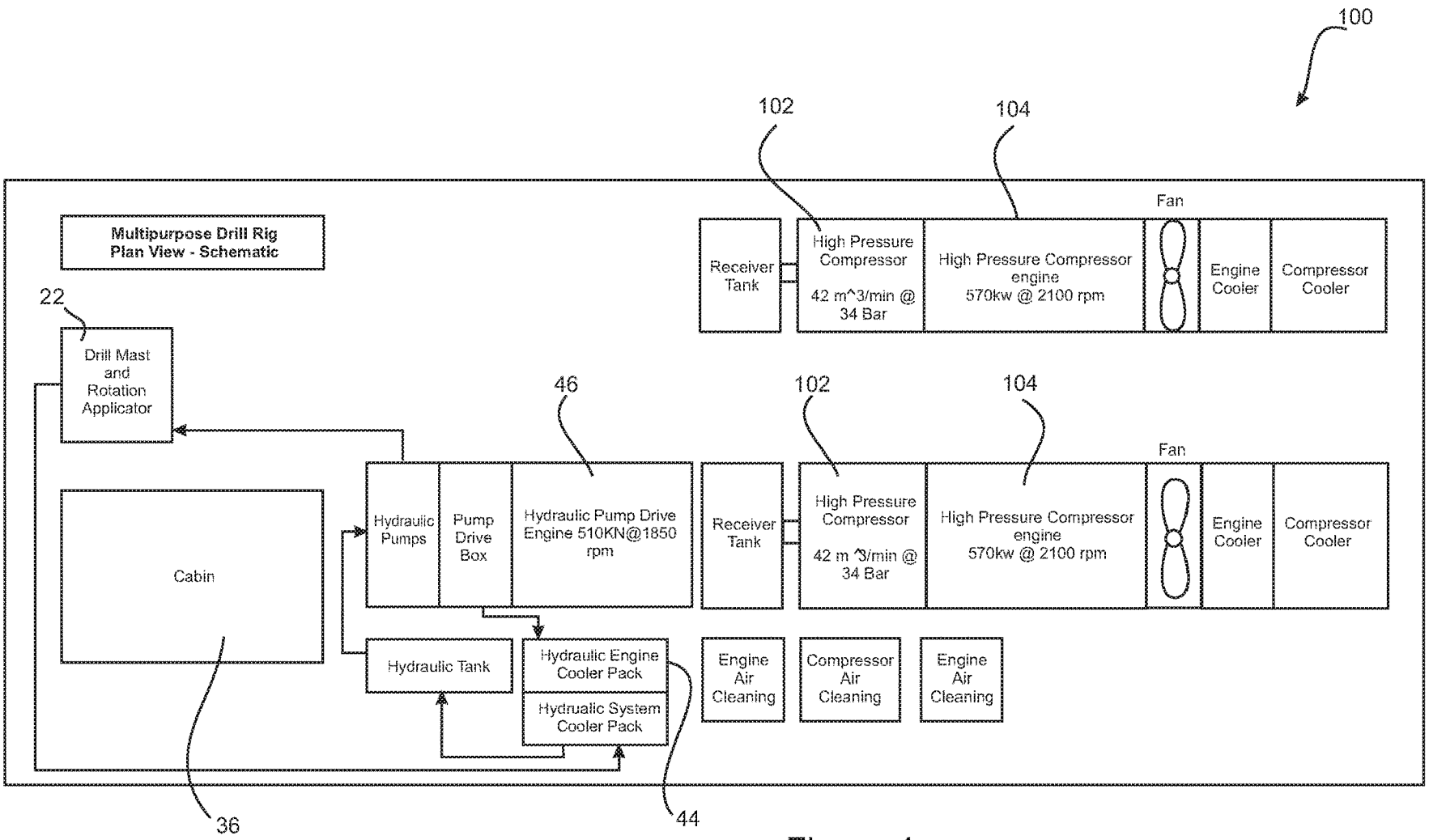
FIG. 4 is a schematic representation of the multipurpose drill system in accordance with a second embodiment of the present invention.

In FIG. 4 there is shown a multipurpose drill system 100 in accordance with a second embodiment of the present invention. The multipurpose drill system 100 shares many features with the above discussed multipurpose drill system 10 and like numeral denote like parts. The multipurpose drill system 100 comprises a drilling rig 12 which is adapted to drive a drilling assembly 14 that drills a borehole in the ground.

The multipurpose drill system 100 is adapted to interchangeably receive different drilling assemblies, such as a rotary drilling (RD) assembly, a percussion assisted rotary drilling (PARD) assembly or a down the hole hammer (DTHH) drilling assembly.

The multipurpose drill system 100 comprises two high pressure power sources, for example two high pressure compressors 102, mounted on the drilling rig 12. Each of the compressors 102 is adapted to provide compressed air to the drilling rig 12 and down the drill pipe 48. In the embodiment shown in the figures, each high pressure compressor 102 is powered by separate engines 104. The separate engines 104 allow the independent operation of each of the high pressure compressors 102.

As discussed above, each drilling assembly 14 has different power source requirements. The inventors have determined that the requirements for each drilling assembly 14 can be provided by one or each of the high pressure compressors 102. Unlike the first embodiment of the present invention, no low pressure power source is provided on the drilling rig 12 to provide a volume of compressed air to the drilling rig 12 and down the drill pipe 48 that is sufficient to operate a RD drilling assembly. In this embodiment, the inventors have determined that both high pressure compressors 102 can be arranged to be in communication with the drilling assembly and can be operated simultaneously to provide the required volume of air. It is envisaged that the pressure of the compressed air provided by each high pressure compressor 102 may need to be regulated so as to match the specifications of the RD drilling assembly.

Similar to the first embodiment, the inventors have determined that the use of parallel high pressure compressors 102 on a single drilling rig 12 is particularly advantageous for the drilling of large diameter holes in formations that contain rock of varying hardness. As would be appreciated by a person skilled in the art, rotary drilling assemblies generally have a high penetration rate and are more economic for drilling in soft rocks. As such, rotary drilling assemblies are typically used for the drilling of large diameter holes into rock with a hardness of less than 200 MPa. However, the use of rotary drilling assemblies for the drilling of large diameter holes in hard rock requires a drilling rig 12 with high pull down and rotation capacity to drive the bit through the rock. This presents a significant capital expenditure for the high capacity drill rig itself, along with higher operating costs to power the compressor. Furthermore, the rotary drill bits may wear at a quicker rate, requiring ongoing replacement costs. These factors together contribute to a much higher cost impediment to such operations. Unlike RD, DTHH drilling assemblies are generally more suited and more economic for drilling of hard rock material. Whilst DTHH drilling for such large diameter hole drilling operations may be preferred, these assemblies require a significantly higher air pressure than RD assemblies and as such, is outside the capacity of conventional low pressure only RD rigs. To increase utility of some large capacity conventional low pressure only drill rigs, some PARD assemblies are used to provide percussive assistance to drill bits used in RD applications. Through this assistance drill penetration rates may be increased in hard rock thereby improved. Unlike conventional drilling systems, the multipurpose drill system 100 of the present invention provides the ability to support multiple large diameter drilling assemblies from a single drilling system. It is envisaged that such a system will allow for the ability to switch between RD, PARD, and DTHH drilling when material of different hardness is encountered.

In the embodiment shown in FIG. 4, separate engines power each of the hydraulic pump mechanism 44, and the separate high pressure compressors 102. It is envisaged that by having three separate engines, the overall operating cost may be reduced and drill rig output optimised to match the rock hardness for the required drill hole diameter. As discussed above, the compressed air requirements of each of the RD and DTHH drilling assemblies are significantly different. Accordingly, the loads experienced by engines operating compressors running to each of these specifications are also different. Whilst it is envisaged that a single engine may operate all of the hydraulic pump mechanism 44 and both the high pressure compressors 102, the inventors have determined that it is less efficient to run such an over specified engine. It is envisaged that the use of individual engines for each of the hydraulic pump mechanism 44 and the high pressure compressors 102 will allow for more efficient energy use. Whilst the engine operating the hydraulic pump mechanism 44 would need to remain running to power the drill hydraulics, the engines 104 would only need to be operated simultaneously when required.

The hydraulic pump mechanism 44 is powered by an engine of specific horsepower to function and operate the hydraulic requirements, for example a 570 kw @ 1850 rpm diesel engine. The preferred hydraulic pump mechanism 44 will provide an open circuit flow rate of approximately 3×425 l/min, a closed circuit flow rate of 2×125 l/min and max pressure of 320 bar.

In a highly preferred embodiment of the present invention, each of the high pressure compressors 102 are each a double stage compressor that produces approximately 40 $m^3$/min. of compressed air at a pressure of ~35 bar. Those skilled in the art would be able to determine the appropriate engine to power the selected high pressure compressor 52, for example a suitable engine to power the high pressure compressor 52 is a ~570 kw @ 2100 rpm diesel engine.

In order to drive the RD assembly for drill hole diameters >200 mm and >200 mPa hard rock, the drill rig requires a pulldown capacity of at least 200 kN. The rotary head requires a minimum 10,000 nm rotation torque.

In use, it envisaged that the multipurpose drill system 100 will enable the operation of each of RD, DTHH drilling and PARD from a single drill rig. In operation, the rig will be positioned adjacent to the site where the hole is to be drilled. The support jacks 20 may be extended and the drill mast 22 will be moved to required hole angle positon. In typical drilling operations, the hardness of the rock at the surface is relatively softer than unweathered or stronger rock formations which may be present at greater depths and so a RD assembly will be fixed to the drill rig. The drill pipe will be arranged to be in communication with both of the high pressure compressors 102. During RD, the engine for the hydraulic pump mechanism 44 will be operated and the engines 104 for each of the high pressure compressors 102 will be operated to operate both high pressure compressors 102 simultaneously. The drilling will commence, with the drill head 38 driving the RD assembly through the rock with the cuttings being flushed out by the compressed air. As the drilling continues additional dill pipe sections may be added until the desired drill hole depth is reached, or the encountered rock hardness becomes uneconomic to drill using RD assemblies due to slow penetration rates or high drill bit wear/consumption.

When portion of rock formations with a greater hardness (~200 MPa) are encountered, the RD drilling ceases and the RD assembly is lifted from drill hole/drill pipe/rod. Once removed from the drill hole, the RD assembly is removed from the drilling rig 12 and is replaced by a DTHH assembly. It is envisaged that the removed assembly may be safely stored on the rig platform 16, thereby allowing it to be easily accessed when again required. The drill pipe will be arranged to be in communication with only one high pressure compressor 102. The engine for the high pressure compressor 102 is operated and the compressed air is sent down the drill pipe 48 to the DTHH drilling assembly 14. Drilling may continue through the rock of greater hardness using the DTHH drilling assembly 14, with the compressed air from the high pressure compressor 102 being used to actuate the DTHH and flush out the cuttings or in application where large volumes of hard rock material are encountered over the entire designed drill hole length.

Once the hard portion of rock has been penetrated, the DTHH drilling assembly 14 may lifted from the hole and the RD assembly can once again be attached. RD through the soft rock may then continue, with the compressed air being supplied by both high pressure compressors 102 simultaneously.

As would be appreciated by a person skilled in the art, blast hole drilling requires an array of holes to be drilled to a predetermined depth, for example 12-15 m. Across the array of holes, the hardness of the rock may vary. It is envisaged that the drilling assembly 10 of the present invention allows for the use of RD drilling techniques for portions where the rock hardness is less than about 200 MPa and DTHH drilling techniques for portions where the rock hardness is more than about 200 MPa.

The present invention will now be described with reference to the following non-limiting examples.

COMPARATIVE EXAMPLE 1

A comparison of the specifications of a RD rig of the prior art (Atlas Copco PV351) and a drilling rig in accordance with a first embodiment of the present invention is shown in the Table 1.

In this embodiment, the drilling rig is provided with the following power sources:

A high pressure power source in the form of a double stage compressor that produces approximately 40 $m^3$/min of compressed air at a pressure of ~35 bar. It is powered by a ~570 kw @ 2100 rpm diesel engine A low pressure power source in the form of a single stage compressor that produces approximately 100 $m^3$/min of compressed air at a pressure of ~7 bar. It is powered by a ~780 kw @ 1850 rpm diesel engine.

TABLE 1

Prior Art Comparison

| Specifications | Existing Art | Example 1 | Comment |
|---|---|---|---|
| Pull Down | Up to 120,000 lbf (534 kN) | Up to 120-140,000 lbf (534-623 kN) | Extra 20,000 lbf (89 kN) pulldown |
| Low pressure air rotary drilling | up to 3,800 cfm @ 110 psi (108 m^3/min @ 7.6Bar) | up to 3,800 cfm @ 110 psi (108 m^3/min @ 7.6Bar) | Equivalent |
| High pressure air hammer drilling | N/A | 1,500 cfm @ 500 psi (42 m^3/min @ 34Bar) | Example 1 enables down hole hammer drilling of +200 MPa rock if required at diameters greater than 200 mm |
| Drill Hole Diameters | 200-450 mm by RD or PARD | 200-450 mm by RD, PARD & DTHH | Existing Art does not provide High Pressure compressed air to enable DTHH drilling of large diameter drill holes. |

As will be noted in Table 1, both systems provide low pressure air rotary drilling, but the drilling system in accordance with the first embodiment of the present invention further provides the ability to use DTHH drilling when the rock strength increases to +200 MPa at diameters above 200 mm.

COMPARATIVE EXAMPLE 2

A comparison of the specifications of a RD rig of the prior art (Atlas Copco PV351) and a drilling rig in accordance with the second embodiment of the present invention is shown in the Table 2.

In this embodiment, the drilling rig is provided with the following power sources.

A first high pressure power source in the form of a double stage compressor that produces approximately 40 $m^3$/min of compressed air at a pressure of ~35 bar. It is powered by a ~570kw @ 2100 rpm diesel engine.

A second high pressure power source in the form of a double stage compressor that produces approximately 40 $m^3$/min of compressed air at a pressure of ~35 bar. It is powered by a ~570kw @ 2100 rpm diesel engine.

TABLE 2

| Prior Art Comparison | | | |
|---|---|---|---|
| Specifications | Existing Art | Example 2 | Comment |
| Pull Down | Up to ~120,000 lbf (534 kN) | Up to 140,000 lbf (534-623 kN) | Extra 20,000 lbf (89 kN) pulldown |
| Low pressure air rotary drilling | up to 3,800 cfm @ 110 psi (108 m^3/min @ 7.6Bar) | up to 3,800 cfm @ 110 psi (108 m^3/min @ 7.6Bar) | Equivalent |
| High pressure air hammer drilling | N/A | Two × ~1,500 cfm @ 500 psi (42 m^3/min @ ~34Bar) | Enables efficient down hole hammer drilling of large diameter holes (>200 mm) in +200 MPa rock if required Increased capacity of additional 1,500 cfm at ~35 bar |
| Drill Hole Diameters | 200-406 mm by RD or PARD | 200-406 mm by RD, PARD & DTHH | Existing Art does not provide high pressure compressed air to enable DTHH drilling of large diameter drill holes. |

As will be noted in Table 2, both systems provide low pressure air rotary drilling, but the drilling system in accordance with this embodiment further provides the ability to use DTHH drilling when the rock strength increases to +200 mpa at diameters above 200 mm. Unlike the first embodiment of the present invention, the drilling rig of the second embodiment has additional volume of high pressure capacity when operating a DTHH drill. The inventors envisage that this will deliver the volume of compressed air to enable DTHH performance at pressures higher than that which is conventionally available on DTHH rigs. This may be used to support DTHH assemblies that operate at pressures up to or above 35 bar and or consumption greater than 1500 cfm/42 $m^3$/min Computer modelling of the use of the system of the present invention has calculated a reduced number of individual drilling systems when completing drilling of large diameter blastholes in harder/higher rock strengths >200 pma. This is achieved through the capability of the multipurpose drill rig to enable a simple change of drilling method from RD to DTHH for large diameter holes (>200 mm) on the same drill rig platform. The current art of sufficient pull-down capacity to complete RD large diameter drill holes does not currently have the high pressure power source capacity to perform DTHH drilling of large diameter holes (>200 mm) economically, or at all. Consequently, through the reduction in the number of drill rigs able to drill the same drill hole diameter in hard rock using DTHH as is currently drilled in softer/less hard rock formations the user is able to achieve an overall reduced capital expenditure on drill rigs plus savings in overall operating expenditure.

Those skilled in the art will appreciate that the invention described herein is susceptible to variations and modifications other than those specifically described. The invention includes all such variation and modifications. The invention also includes all of the steps, features, formulations and compounds referred to or indicated in the specification, individually or collectively and any and all combinations or any two or more of the steps or features.

The invention claimed is:

1. A multipurpose drill system, the multipurpose drill system comprising:

a drilling rig adapted to drive a drilling assembly;

two or more power sources in selective communication with the drilling assembly, the two or more power sources configured to deliver a fluid stream to the drilling assembly to flush drill cuttings generated by the drilling assembly, wherein at least one of the two or more power sources is a high pressure power source and at least one of the two or more power sources is a low pressure power source or a second high pressure power source, wherein the drilling rig is adapted to interchangeably receive at least rotary drilling assemblies and down the hole hammer drilling assemblies and where the drilling assembly is a down the hole hammer drilling assembly, the fluid stream further actuates a hammer assembly of the down the hole hammer drilling assembly.

2. A multipurpose drill system according to claim 1, where the fluid stream is a gas, each of the two or more power sources will be compressor apparatus.

3. A multipurpose drill system according to claim 2, wherein the one or more high pressure power sources are each capable of providing a supply of compressed air with a pressure of at least 10 Bar.

4. A multipurpose drill system according to claim 1, wherein the low pressure power source is capable of providing a supply of compressed air with a volume of at least 15 $m^3$/min at a maximum pressure of 10 bar.

5. A multipurpose drill system according to claim 1, wherein the multipurpose drill system further comprises at least one engine to power the two or more power sources.

6. A multipurpose drill system according to claim 1, wherein the drilling rig is further adapted to interchangeably receive percussion assisted rotary drilling assemblies and where the fluid stream further actuates a hammer assembly of the percussion assisted rotary drilling assembly.

7. A multipurpose drill system according to claim 1, wherein the two or more power sources operate independently.

8. A multipurpose drill system according to claim 1, wherein the drilling assembly is adapted to be selectively switched between communication with each power source independently or two or more power sources simultaneously.

9. A multipurpose drill system according to claim 1, wherein at least one engine independently powers each power source.

10. A multipurpose drill system according to claim 1, wherein the multipurpose drill system is mounted on a mobile rig platform.

11. A method of drilling, the method comprising the use of the multipurpose drill system of claim 1.

* * * * *